United States Patent [19]

Grim

[11] Patent Number: 4,554,553

[45] Date of Patent: Nov. 19, 1985

[54] POLARIZED SIGNAL RECEIVER PROBE

[76] Inventor: Fay Grim, 565 Newburgh, Port Charlotte, Fla. 33952

[21] Appl. No.: 621,119

[22] Filed: Jun. 15, 1984

[51] Int. Cl.[4] ..... H01P 1/165; H01Q 13/02

[52] U.S. Cl. ..... 343/786; 333/21 A; 333/21 R

[58] Field of Search ..... 333/21 A, 21 R, 26, 333/33, 34, 35, 254, 257, 261, 230; 343/786, 789, 791, 756, 768, 770, 772

[56] References Cited

U.S. PATENT DOCUMENTS

| | | | |
|---|---|---|---|
| 2,548,821 | 4/1951 | Riblet et al. | 343/784 |
| 2,635,191 | 4/1953 | Swarts, Jr. | 333/26 X |
| 2,742,612 | 4/1956 | Cohn | 333/157 X |
| 2,880,399 | 3/1959 | Murphy | 333/33 X |
| 3,143,717 | 8/1964 | Gordon | 333/261 |
| 3,534,376 | 10/1970 | Webb | 343/786 |
| 3,681,714 | 10/1972 | Terakawa | 333/33 X |
| 4,168,504 | 9/1979 | Davis | 343/772 X |
| 4,414,516 | 11/1983 | Howard | 333/21 A |
| 4,504,836 | 3/1985 | Seavey | 343/786 X |
| 4,528,528 | 7/1985 | Augustin | 343/786 X |

FOREIGN PATENT DOCUMENTS

| | | | |
|---|---|---|---|
| 0055150 | 5/1979 | Japan | 333/26 |

*Primary Examiner*—Eugene R. LaRoche
*Assistant Examiner*—Benny T. Lee
*Attorney, Agent, or Firm*—Hauke and Patalidis

[57] ABSTRACT

A polarized signal receiver, transmission and launch probe in a waveguide assembly for receiving a selected one of linearly polarized electromagnetic signals in one of the waveguides and for launching the selected signal into a second waveguide, the axes of the waveguides being disposed at right angle. The probe comprises a signal receiver probe portion disposed in a plane perpendicular to the axis of the first waveguide and a launch probe portion having its axis perpendicular to the axis of the second waveguide. The launch probe portion is mounted in a controllably rotatable dielectric rod, such that rotation of the rod causes rotation of the signal receiver portion for alignment with a selected one of the polarized signals. The transmission line between the signal receiver probe portion and the signal launch probe portion consists of a pair of bifurcated branches forming a rectangle disposed along the axis of the first waveguide.

9 Claims, 3 Drawing Figures

POLARIZED SIGNAL RECEIVER PROBE

BACKGROUND OF THE INVENTION

The present invention relates to a polarized signal receiver probe in general, and more particularly to a probe for detecting a polarized signal in a first waveguide and for launching the signal in a second waveguide disposed at right angle to the first waveguide.

Two linearly polarized signals, rotated 90° from each other are used in satellite communications systems. The transmitted linearly polarized signals are received by way of a feed horn installed on the end, or forming part of, a circular waveguide, i.e. of circular cross-section. Only one of the two polarized signals is received, the other signal being reflected out of the feed horn. The detected signal is fed through a second waveguide, generally a rectangular waveguide, i.e. of rectangular cross-section whose axis is conventionally disposed at 90° to the axis of the feed horn waveguide, and which feeds the detected signal to a low-noise amplifier.

Various arrangements may be used for receiving one of the polarized signals in the feed horn circular waveguide and for launching the detected signal into the rectangular waveguide, such as, for example, the probe disclosed in U.S. Pat. No. 4,414,516 comprising a receiver probe portion disposed in the circular waveguide, and a signal launch probe portion disposed in the rectangular waveguide, the probe being supported by a rotatable dielectric rod driven by a servomotor mounted on the waveguide assembly. The launch probe portion has its axis aligned with the axis of the circular waveguide and with the axis of the dielectric rod, such as to remain constantly perpendicular to the axis of the rectangular waveguide during rotation of the probe. The receiver probe portion has its longitudinal axis perpendicular to the axis of rotation such as to rotate between the two orthogonally polarized signals in the circular waveguide. By rotation to a desired position, one polarized signal is received and the other is reflected. The received signal is conducted by the transmission line portion of the probe through the rear wall of the circular waveguide and is launched into the rectangular waveguide by the launch probe portion.

The present invention is an improvement upon the prior art polarized signal receiver, transmission and launch probes.

SUMMARY

The present invention provides a polarized signal receiver, transmission and launch system in the form of a probe for receiving an appropriate one of two linearly polarized signals, disposed 90° from each other and being fed into a first waveguide, for transmitting the selected one of the signals to a second waveguide disposed perpendicularly to the first waveguide, and for launching the selected signal in the second waveguide. The present invention, due to its particular structure and to the particular structure of the transmission line portion between the receiver probe portion and the launch probe portion, provides a great improvement in reduction of parasitical capacitance during transmission of signals from one waveguide to another, a greatly improved signal-to-noise ratio, and an improved rejection of the unwanted signals, as compared to the polarized signal receiver, transmission and launch systems heretofore available.

A better understanding of the present invention and of its many objects and advantages will become apparent from the following description of the best mode contemplated for practicing the invention, when read in conjunction with the accompanying drawing wherein:

DETAILED DESCRIPTION OF THE PREFERRED EMBODIMENT

Figure 1:
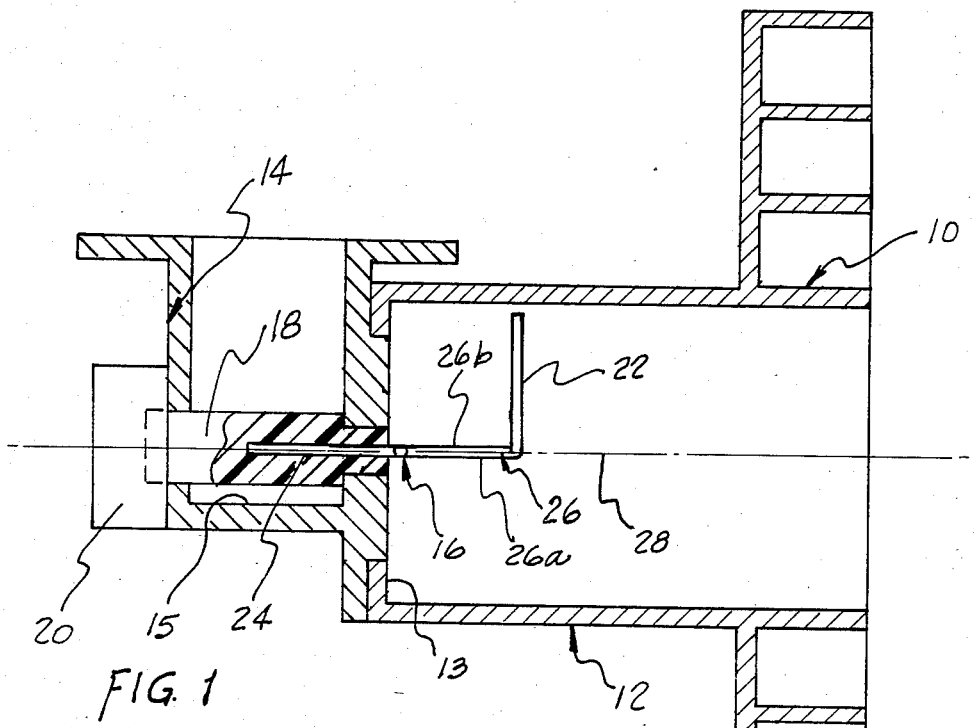
FIG. 1 is a schematic sectional view of a waveguide assembly provided with an internal rotating signal receiver, transmission and launching probe according to the present invention.

Referring now to the drawing, and more particularly to FIG. 1, there is illustrated a feed horn 10 on the open end of, and coaxially coupled to, a circular waveguide 12, i.e. of circular cross-section. The circular waveguide 12 has a rear wall 13 and is coupled at right angle to a rectangular waveguide 14, i.e. of rectangular cross-section, attached to the closed end of the circular waveguide 12. The rectangular waveguide 14 is closed at one end by an end or rear wall 15 and is coupled at its open end to a low-noise signal amplifier, not shown. A receiver, transmission and launch probe 16, according to the present invention, is fixedly mounted coaxially in a dielectric rod or shaft 18 disposed rotatable through the rear wall 13 of the circular waveguide 12 and which is driven by a servomotor 20.

Figure 2:
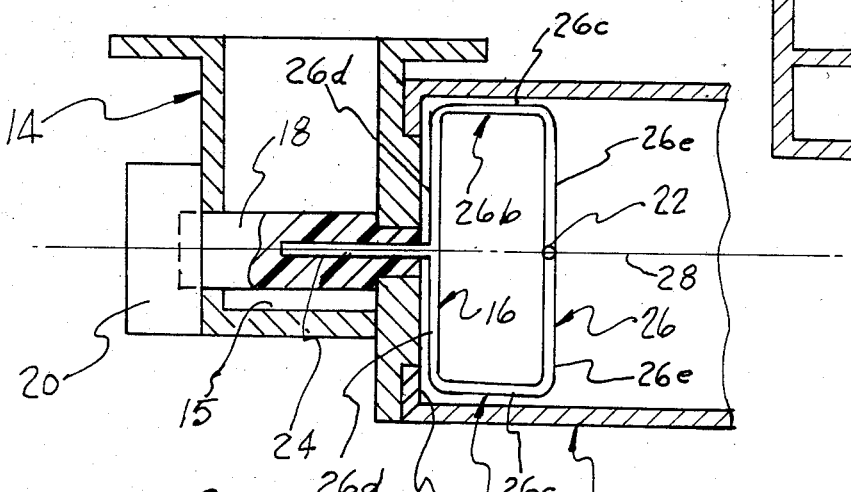
FIG. 2 is a partial view similar to FIG. 1 but showing the probe rotated 90° from the position shown at FIG. 1.
Figure 3:
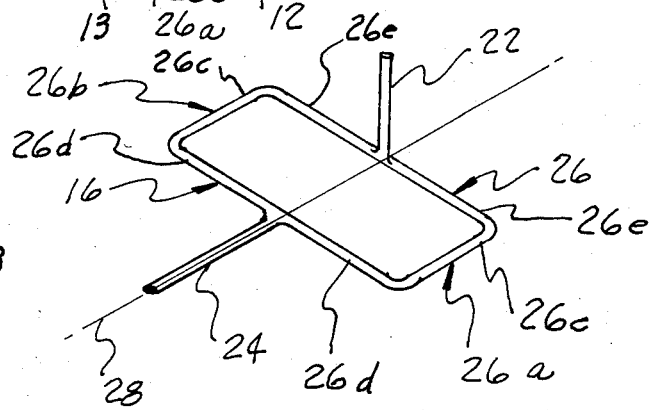
FIG. 3 is a perspective view of the probe portion thereof.

The probe 16 is made of a single continuous electrical conductor and, preferably, of a single-piece precision casting of electrically conductive metal or alloy. The probe 16 comprises a receiver probe portion 22, one-quarter wavelength long, having its longitudinal axis disposed in a plane perpendicular to the longitudinal axis of the circular waveguide 12, and a signal launch probe portion 24 held within the dielectric rod 18 with its longitudinal axis aligned with the longitudinal axis, or axis of symmetry, of the circular waveguide 12. The signal launch probe portion 24 projects within the rectangular waveguide 14, perpendicularly to the axis of the waveguide 14. The signal receiver probe portion 22 of the probe 16 and the signal launch probe portion 24 are integrally connected by a transmission line portion 26. The transmission line portion 26 is substantially a rectangle disposed in a plane aligned with the longitudinal axis of the signal launch probe portion 24, and perpendicular to the longitudinal axis of the signal receiver probe portion 22. As best shown in FIGS. 2 and 3, the transmission line portion 26 is formed of two U-shaped branches **26*a* and 26*b*, respectively, which, relative to an axis of symmetry 28, are equal in length. The axis of symmetry 28 coincides with the longitudinal axis of the circular waveguide 12 and with the axis of rotation of the probe 16. Equality of the lengths of the transmission line branches 26*a* and 26*b* is critical for minimizing signal strength losses between the signal receiver probe portion 22 and the signal launch probe portion 24. Accurate fabrication of the probe 16, such as by precision casting, results in providing equal length branches 26*a* and 26*b* for the transmission line 26, and in providing accurate one-quarter wavelength for the signal receiver probe portion 22**, for better rejection of unwanted signals, and improved signal-to-noise ratio performance.

The particular configuration of the probe transmission line 26 between the signal receiver probe portion 22 and the signal launch probe portion 24 results in a practically capacitanceless transmission line, and in good impedance match between the two waveguides 12 and 14. The length of the portion **26*c* of each branch, parallel to the axis 28 of the waveguide 12, is preferably one-quarter of a wavelength. The length of the portions 26*d* and 26*e* is also preferably approximately one-quarter of a wavelength. The portions 26*d* are parallel to the rear wall 13 of the waveguide 12, and about 2 to 4 mm. away from the surface of the rear wall 13. The length of the launch probe portion 24 is not critical, as long as the launch probe portion 24 extends into the waveguide 14 beyond the end wall 13. Typically, and only for the sake of convenience, the length of the launch probe portion 24 extending into the waveguide 14** is approximately 1/6 of the wavelength.

In operation, the probe 16 is rotatively driven, from a remote control location, by way of the servomotor 20 rotating the dielectric rod 18, thus causing the signal receiver probe portion 22 to sweep a circular plane in the circular waveguide 12, perpendicular to the axis 28. As the signal receiver probe portion 22 aligns itself with the desired linearly polarized signal in the circular waveguide 12, the detected signal is transmitted through the bifurcated transmission line 26 to the signal launch probe portion 24. The desired orientation of the signal receiver probe portion 22 is determined by a peak in the detected signal amplitude. The signal launched by the signal launch probe portion 24 is evidently unaffected by the rotation of the probe 16, because the launch signal probe portion 24 rotates around the axis of symmetry 28.

Having thus described the present invention by way of an example of structure thereof, modifications whereof will be apparent to those skilled in the art, what is claimed as new is as follows:

1. A polarized signal receiver comprising a first waveguide of circular cross-section for receiving polarized electromagnetic signals applied to an open end thereof, said first waveguide having an axis of symmetry and another end closed by a rear wall, a second waveguide for transmitting polarized signals, said second waveguide having an axis of symmetry and said first and second waveguides being disposed with their axes of symmetry at a substantially 90° angle, a dielectric rod mounted through the rear wall of said first waveguide, said dielectric rod being rotatable around an axis of rotation aligned with the axis of symmetry of said first waveguide, a signal transferring probe fixedly mounted in said dielectric rod for rotation thereby about the axis of rotation thereof, said signal transferring probe comprising a receiver probe portion disposed in said first waveguide in a plane orthogonal to the axis of symmetry of said first waveguide for receiving one of the polarized signals in said first waveguide, a signal launch probe portion extending into the second waveguide substantially perpendicular to the axis of symmetry of said second waveguide, said signal launch probe portion being disposed concentric within said dielectric rod, and a transmission line portion connecting said signal receiver probe portion to said signal launch probe portion, said transmission line portion having two integral oppositely directed and symmetrical generally U-shaped branch portions forming a rectangle disposed in said first waveguide in a single plane along the axis of symmetry of said first waveguide and perpendicular to the plane in which said signal receiver probe portion is disposed, and means for controllably rotating said dielectric rod and said signal transferring probe for transferring a selected one of said polarized signals from said first waveguide to said second waveguide at a peak of signal amplitude in said second waveguide.

2. The polarized signal receiver of claim 1 wherein said branches of said transmission line are of equal length.

3. The polarized signal receiver of claim 1 wherein said signal receiver probe portion is a quarter of a wavelength long.

4. The polarized signal receiver of claim 2 wherein said signal receiver probe portion is a quarter of a wavelength long.

5. The polarized signal receiver of claim 1 wherein said signal receiver probe portion, said signal launch probe portion and said signal transmission line are made of a single-piece metallic casting.

6. The polarized signal receiver of claim 2 wherein said signal receiver probe portion, said signal launch probe portion and said signal transmission line are made of a single-piece metallic casting.

7. The polarized signal receiver of claim 3 wherein said signal receiver probe portion, said signal launch probe portion and said signal transmission line are made of a single-piece metallic casting.

8. The polarized signal receiver of claim 4 wherein said signal receiver probe portion, said signal launch probe portion and said signal transmission line are made of a single-piece metallic casting.

9. The polarized signal receiver of claim 1 wherein said second waveguide is rectangular in cross-section.

* * * * *